United States Patent [19]

Bielinski

[11] 4,053,990

[45] Oct. 18, 1977

[54] DIFFERENTIAL PRESSURE DRYING AND SOLVENT RECOVERY UNIT

[75] Inventor: George D. Bielinski, Appleton, Wis.

[73] Assignee: Sav-Sol Drying Systems, Inc., Appleton, Wis.

[21] Appl. No.: 663,445

[22] Filed: Mar. 3, 1976

[51] Int. Cl.[2] ..... F26B 3/00; F26B 5/12; F26B 13/30

[52] U.S. Cl. ..... 34/23; 34/26; 34/27; 34/28; 34/92; 34/156

[58] Field of Search ..... 34/23, 26, 27, 28, 74, 34/75, 92, 156

[56] References Cited

U.S. PATENT DOCUMENTS

| | | | |
|---|---|---|---|
| 3,633,283 | 1/1972 | Mishkin et al. | 34/92 |
| 3,706,138 | 12/1972 | Schuierer | 34/156 |
| 3,724,088 | 4/1973 | Lefebvre et al. | 34/23 |
| 3,798,787 | 3/1974 | Heen | 34/75 |

*Primary Examiner*—John J. Camby
*Attorney, Agent, or Firm*—Quarles & Brady

[57] ABSTRACT

A web of solvent bearing material is passed through a series of spaced apart solvent stripping slots while at the same time gas streams are sucked through the slots to float the web in the slots and to strip solvent from the web. In a preferred embodiment the gas stream is heated before it enters the slots and the web is heated between slots to enhance and increase the vaporization rate of the solvent and the gas streams and solvent vapors leaving the slots are conveyed to a fractional condenser which condenses the solvent, and if the solvent is a solvent other than water, separates the water which might be present from the solvent, and collects the solvent for re-use. An improved drying apparatus is disclosed for maintaining a stable continuous partial vacuum upon the web passing through the apparatus while providing for both an upstream and a downstream flow of gas over said web.

28 Claims, 9 Drawing Figures

DIFFERENTIAL PRESSURE DRYING AND SOLVENT RECOVERY UNIT

BACKGROUND OF THE INVENTION

Many different solvents, including water and organic solvents are used in coating, printing, dyeing, impregnating, sizing, papermaking, waterproofing, waxing or otherwise treating webs made of paper, plastic, metal, cloth, rubber, textiles, etc. The principal object of the invention is to provide an improved method and apparatus for drying such webs. It is a further object to provide a method and apparatus for recovering the solvent for re-use.

In the past, forced circulation of air over the surface of a web within closed vacuum chambers has been employed to dry the web as disclosed in U.S. Pat. No. 1,487,362 to O. D. Rice. It has also been known to dry the web by heating it with radiant heaters or gas flames which when organic solvents are used can also incinerate the organic solvent vapor. In the past, the recovery of a portion of the organic solvent has been accomplished by passing the solvent vapors removed from the web through a series of absorbent activated carbon beds, then passing steam through the solvent saturated activated carbon bed to remove the absorbed solvent as solvent-water mixture, which was subsequently in a secondary process fractionally distilled to separate the organic solvent from the water. However, the activated carbon beds are limited to absorbing only a small percentage of their weight in organic solvent, and, therefore, the beds must be quite large. Several of these large beds are typically required, inasmuch as the organic solvent vapors must be passed through an unsaturated bed while the organic solvent is being removed from the saturated bed or beds. In addition to large size, the activated carbon absorption method is relatively expensive in cost and use of energy and recovers only a portion of the solvent used in processing the web.

SUMMARY OF THE INVENTION

In accordance with the method of the present invention, solvent is stripped from a moving web in a drying apparatus, and the solvent vapor is condensed in a fractional condenser which condenses the solvent vapor, and if both organic solvent and water are present, separates the organic solvent from the water, and collects the organic solvent for re-use. By practice of the preferred method, substantially all of the organic solvent originally in the web may be collected for re-use at a relatively low cost. The technique and apparatus for stripping the solvent from the web is summarized in the foregoing abstract of the disclosure.

Other objects, features and advantages of the invention will appear from the disclosure hereof.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
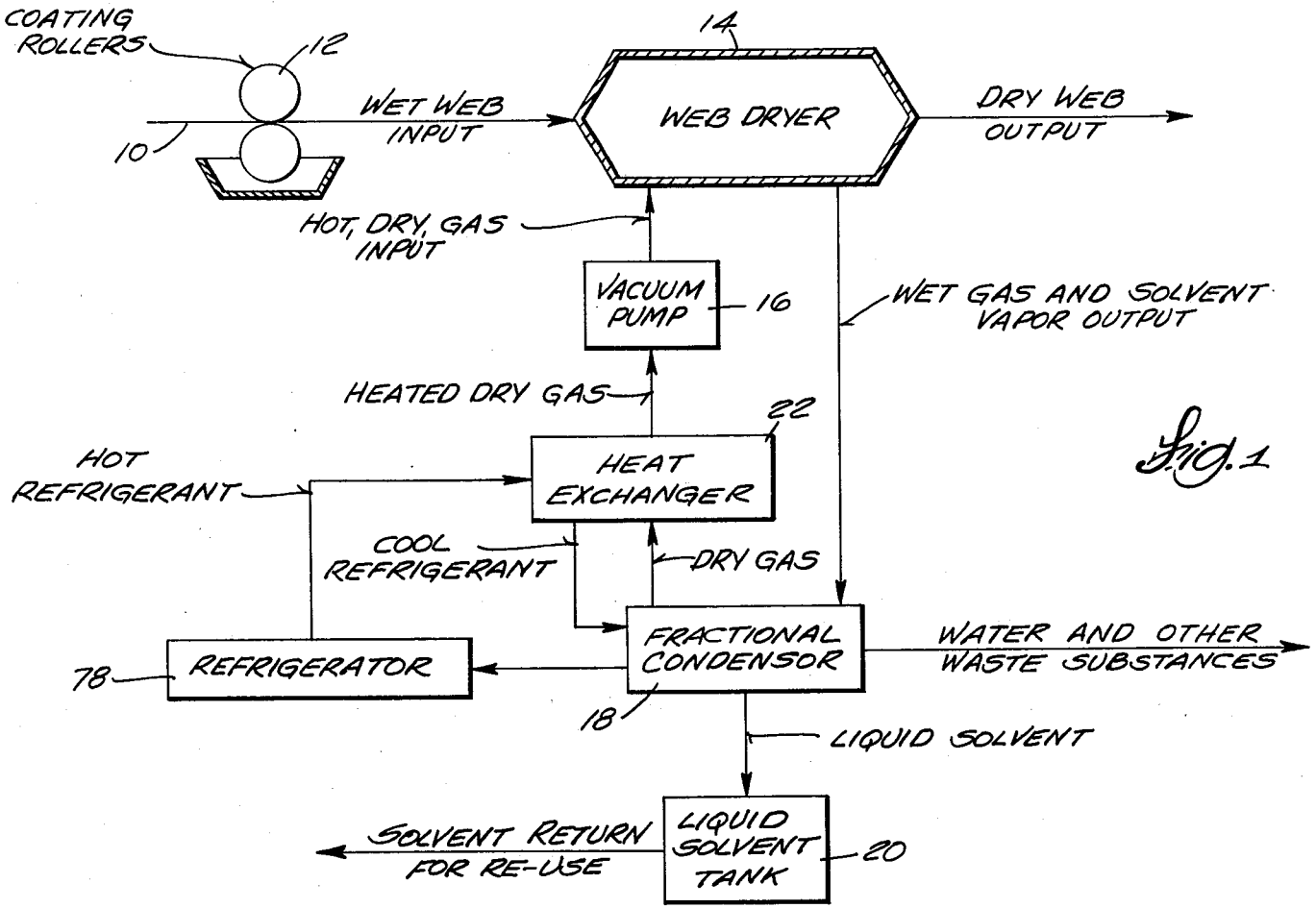
FIG. 1 is a process flow diagram illustrating the method of this invention.
Figure 5A:
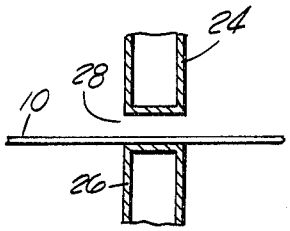
FIGS. 5A–5C are longitudinal fragmentary sectional views of one solvent stripping slot illustrating web flotation and solvent stripping.
Figure 5B:
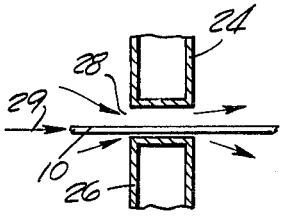
Figure 5C:
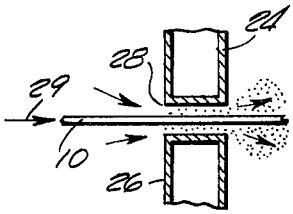

Referring to FIG. 1, the method of this invention broadly comprises the steps of (1) passing a gas stream over the web to remove solvent therefrom; (2) passing the gas stream containing solvent vapor through a condenser to condense the solvent vapor; and (3) collecting the condensed solvent. The web is preferably passed through at least one and preferably a series of solvent stripping slots 28, such as shown in FIGS. 5A–5C, while two streams of gas are impelled through the slot above and below the web to float the web in the slot and simultaneously strip the solvent from the web. FIG. 5A shows the position of the web at rest; FIG. 5B shows its position when the flow of gas is commenced; and FIG. 5C shows the position with full gas stream flow. The gas stream is preferably heated before entering the slot to increase vaporization of the solvents and the web is preferably heated before entering the slot for the same reason.

In the preferred embodiment, as seen in FIG. 1, a web 10 of material which can be paper, plastic, textile fabric, metal foil, or any other suitable material is typically coated by a coating roller 12 with a substance dissolved or suspended in solvent such as acetone. The coating rollers 12 are merely exemplary since many different types of processes utilizing solvents can be employed, such as printing, dyeing, impregnating, sizing, papermaking, waterproofing, waxing, etc. Also, acetone is merely exemplary of a large group of solvents which can be removed and salvaged for re-use in accordance with the method and apparatus of this invention. The term "solvent" as used herein includes water, as well as, all the conventional organic solvents such as the aliphatic hydrocarbons, the aromatic hydrocarbons, the cyclic hydrocarbons and derivatives thereof including but not limited to oxygenated and halogenated derivatives.

The solvent bearing web, which usually carries a small amount of water in addition to an organic solvent, is passed through a web dryer 14 in which one or more gas streams are passed over the web surface to remove solvent therefrom.

The gas stream is impelled through the web dryer 14 by a vacuum pump 16, which also develops a vacuum within the web dryer 14 to increase and enhance the vaporization of the solvent.

Although many gases including air can be employed, it is generally preferred, especially when organic solvents are involved, to exclude air from the system and employ a gas which is inert under conditions of use such as nitrogen or carbon dioxide. Generally, the use of such an inert gas not only improves the efficiency of the process and reduces energy consumption but also reduces explosive potential. The gas employed should also be "dry", i.e., possess the ability to accept and transport the solvent vapors desired to be removed from the web.

The vacuum pump 16 moves the gas stream which has passed over the web and contains solvent vapor to a fractional condenser 18 which separates any water which may be present from the organic solvent and collects the organic solvent, which may be then conveyed to a liquid solvent tank 20 for storage prior to re-use. The water, if any, and other waste products may be recycled but usually are discharged from fractional condenser 18 from a different outlet. The dry gas which has given up the solvent vapors is returned to the web dryer 14, preferably, first passing through a heat exchanger 22.

Figure 2:
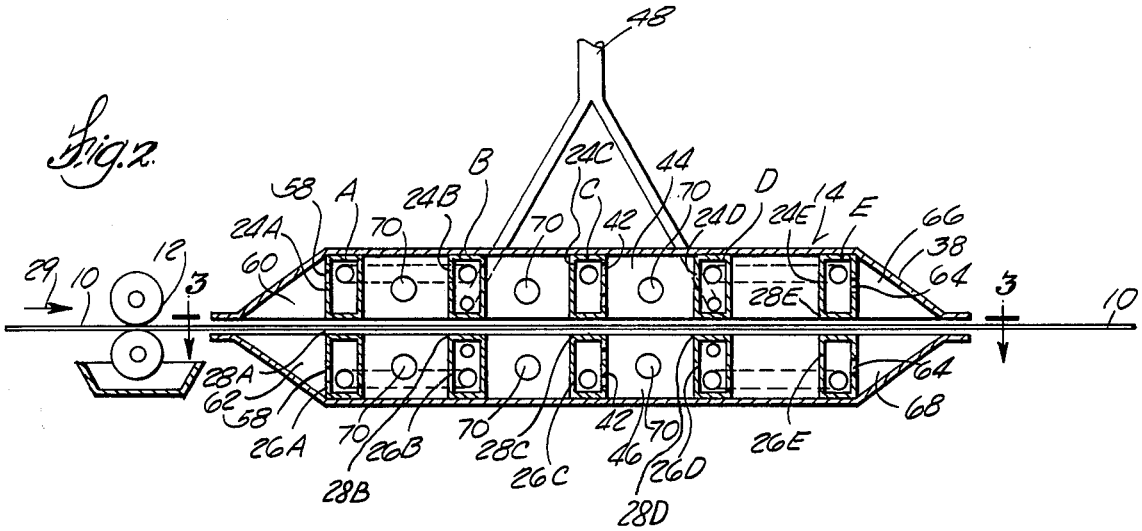
FIG. 2 is a longitudinal sectional view of the preferred web dryer and solvent collector.
Figure 4:
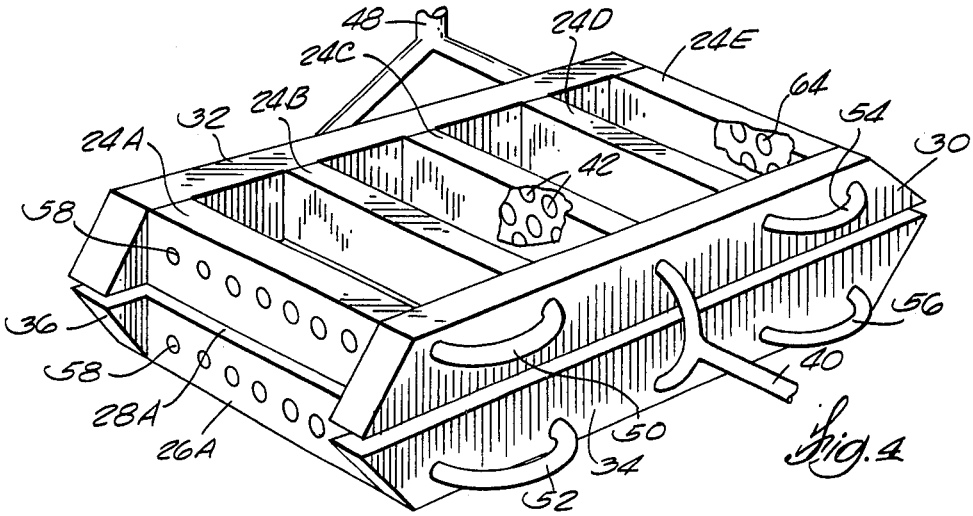
FIG. 4 is a fragmentary perspective view of the web dryer and solvent collector shown in FIGS. 2 and 3, with the housing shell removed.

As shown in FIGS. 2 and 4, the preferred embodiment of the web dryer 14 contains a plurality of partitions, each comprising opposed rectangular conduits 24 and 26 which are arranged in sets 24A, 26A; 24B, 26B; 24C, 26C; etc. The conduits 24 and 26 are spaced apart to form solvent stripping slots 28 in the medial centerline of the apparatus. These are most clearly shown in FIGS. 5A through 5C. The slots 28 are relatively long in the direction of web travel indicated by arrow 29 in comparison to the spacing between opposed faces of conduits 24, 26 in a direction transverse to arrow 29, hereinafter referred to as slot width. The slots preferably have an aspect ratio of 20 or greater for good solvent removal and minimum web flutter. Aspect ratio is defined as the slot length divided by the slot width. As the web 10 passes through slot 28, two gas streams, indicated by the arrows in FIGS. 5B and 5C, are impelled through slot 28 above and below web 10 to float web 10 within slot 28 stripping solvents therefrom. The gas streams are preferably impelled by applying a vacuum to one side of slot 28 as described in detail hereinafter.

In the illustrated embodiment, five sets of rectangular conduits 24 and 26 are mounted with their slots in horizontal alignment within the web dryer 14 as space apart positions indicated by the letters A–E in FIG. 2. Hereinafter, the conduits 24 and 26 and slots 28 will be identified by a suffix letter indicating a designated station. For example, slot 28A is located at position A, slot 28B is located at position B, and so on.

As best shown in FIG. 4, rectangular conduits 24A through 24E and 26A through 26E are held in spaced apart relationship by side rails 30, 32, 34 and 36, which are hollow in construction but which do not communicate into the interior of rectangular conduits 24A–24E and 26A–26E. Side rails 30, 32, 34, and 36 are held in spaced apart relationship by an outer housing shell 38 (FIG. 2) which is not shown in FIG. 4. Outer shell 38 is attached to the side rails 30, 32, 34 and 36 by conventional means not shown.

Suction is applied to the central rectangular conduits 24C and 26C by a vacuum manifold 40, FIG. 4, which passes through side rails 30 and 34 and connects into the interior of conduits 24C and 26C. Vacuum manifold 40 is coupled to the vacuum side of vacuum pump 16, FIG. 1, and rectangular conduits 24C and 26C are provided with vacuum ports 42 on their downstream sides, thus extending the vacuum into the chambers 44 and 46, FIG. 2, immediately downstream of the central slot 28C. The suction due to the vacuum in chambers 44 and 46 causes gas streams to be sucked through the slots 28 above and below web 10 as illustrated in FIGS. 5B and 5C to float web 10 within slots 28 and aids in stripping solvent therefrom. The gas streams through the upstream slots 28A, 28B and 28C move in the direction of web travel while the gas stream sucked through the downstream slots 28D and 28E move against the direction of web travel. The provision of both upstream and downstream flow of gas is especially advantageous in removing solvent from webs of non-smooth material as it prevents the entrapment of solvent by the nap of the web.

The boundary layer of vapor that is attached to web 10 as it enters the slot 28 is subjected to horizontal shear, first in the direction of the web and then against the direction of the web. This disturbance appears to have three actions. First, the increase in velocity decreases the pressure and increases the vacuum on the web which increases evaporation. Second, the physical volume of the solvent vapor increases due to the rise in temperature and phase change from liquid to gas. This aids stabilization of the web. Third, as the web passes from the slot, the vacuum is reapplied to remove the vapor. These actions cooperate to prevent the formation of a solvent vapor pressure concentration on the web air interface which can interfere with evaporation.

The pulsating action on the web as it passes from a slot to an open chamber to the next slot causes the gas to penetrate the fiber or coating matrix, thereby gently removing the solvent.

Figure 3:
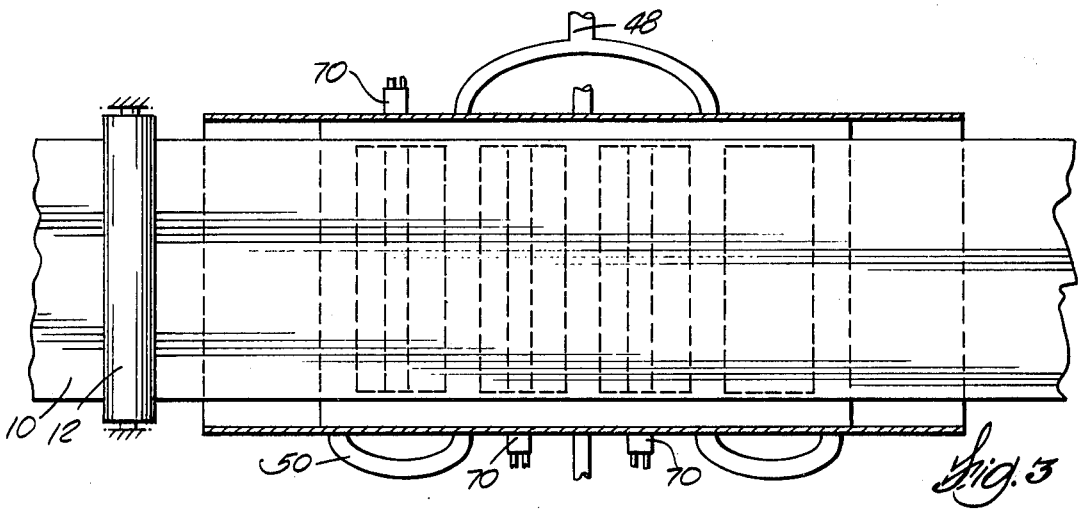
FIG. 3 is a sectional view taken on line 3—3 of FIG. 2.

The return or pressure side of vacuum pump 16 (FIG. 1) is coupled to a gas supply manifold 48 (FIGS. 2 through 4). Manifold 48 is connected with the rectangular conduits 24B, 26B, 24D and 26D which in turn are coupled by jumper conduits 50, 52, 54, 56 (FIG. 4) to the rectangular conduits 24A, 26A, 24E and 26E. Rectangular conduits 24A and 26A are provided with ports 58 on their upstream sides (best seen in FIGS. 2 and 4) to return the gas stream from vacuum pump 16 to the chambers 60 and 62 (FIG. 2) which are immediately upstream of the first stripping slot 28A. Rectangular conduits 24E and 26E are provided with ports 64 (FIG. 4) on their downstream sides to return the gas stream from vacuum pump 16 to chambers 66 and 68 (FIG. 2) immediately downstream of stripping slot 28E. Although for purposes of illustration, the ports 58 and 64 are shown as being of equal size and shape, it should be understood that a wide variety of shapes, sizes and arrangements of ports may be employed, if it is desired, for example, to increase gas flow, increase or decrease web pulsation or the like.

The return gas stream which is communicated into chambers 60, 62, 66 and 68 is preferably stripped of solvents and dried by the fractional condenser 18 (FIG. 1) and heated by heat exchanger 22 and the vacuum pump 16 before it enters the web dryer 14.

In the web dryer 14, the heated, dry gas is drawn downstream over the web from chambers 60, 62 through solvent stripping slots 28A, 28B and 28C and is drawn upstream over the web from the chambers 66, 68 through solvent stripping slots 28E and 28D by the vacuum applied to chambers 44 and 46. As the heated, dry gas passes over the web 10 within solvent stripping slots 28, the chambers between the slots, and chambers 44 and 46, it strips the solvent as vapor from the web and carries the solvent vapor along with the gas stream.

The vacuum in central chambers 44 and 46 is communicated through slots 28 to the adjacent chambers. However, due to the resistance to gas flow through slots 28, the pressure is progressively lowered from one chamber to another from the leading chambers 60 and 62 and trailing chambers 66 and 68 to the central chambers 44 and 46 which receive the maximum vacuum of the system.

As previously stated the evaporation of the solvent and water vapor is enhanced by heating the gas stream. In addition, it may be further enhanced by heating the web 10 with a series of radiant heaters 70 (FIG. 2) which may be mounted by conventional means in the space between rectangular conduits 24 and 26. In the case where acetone is the solvent, the gas utilized is preferably nitrogen and it is preferably heated to a temperature of about 10° C in the heat exchanger 22 and the heaters 70 are preferably infrared radiant heaters which can operate over a broad range of temperatures and in the case of acetone at a temperature of at least 60° C. Of course, other solvents do require higher or lower temperatures in accordance with their vaporization characteristics as is well known to those skilled in the art.

Figure 6:
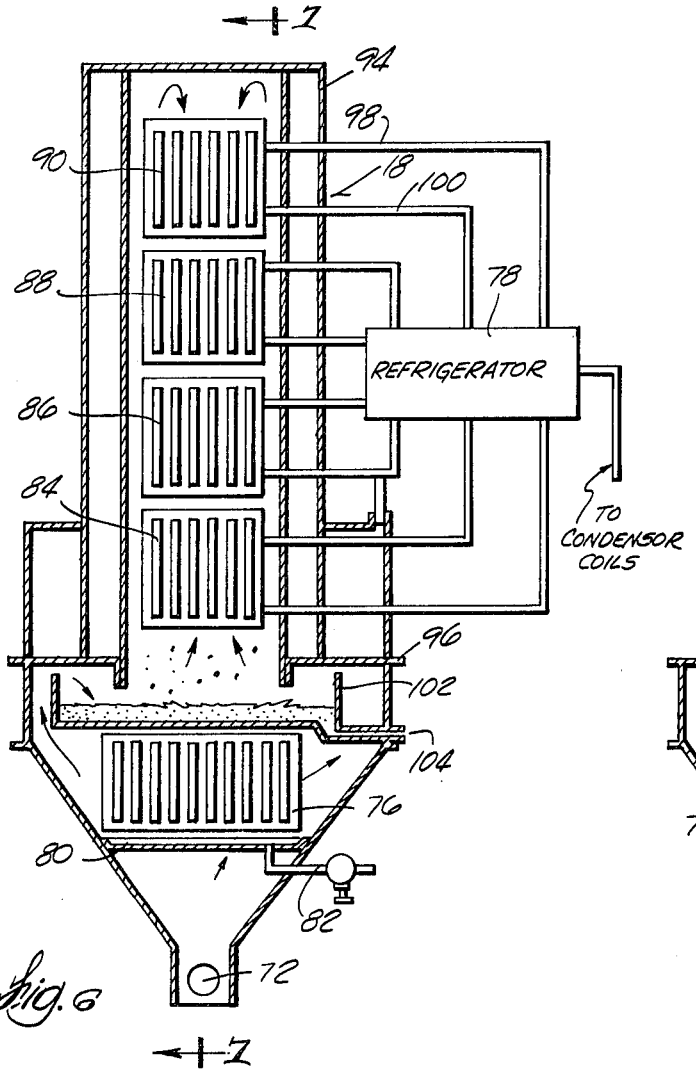
FIG. 6 is a longitudinal sectional view of a preferred fractional condenser.
Figure 7:
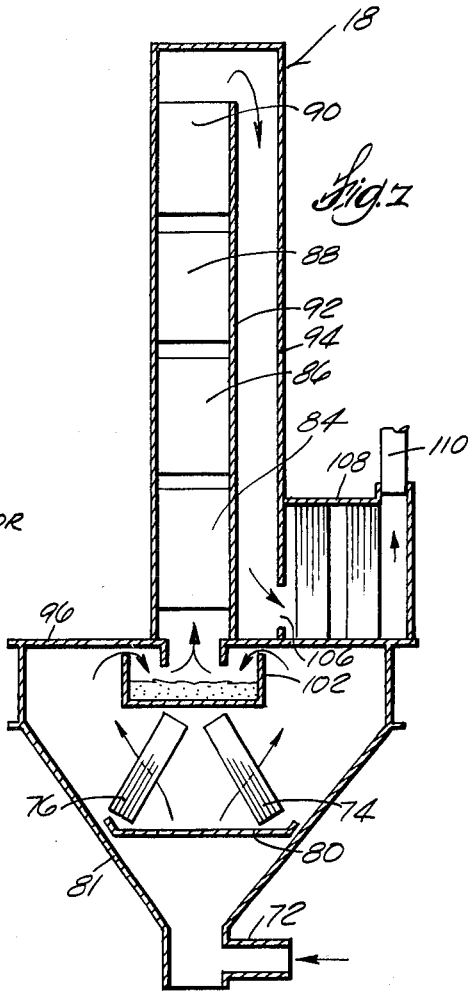
FIG. 7 is a longitudinal sectional view taken on the line 7—7 of FIG. 6.

FIGS. 6 and 7 show the preferred fractional condenser 18. In this condenser the heated gas stream from the web dryer 14 carrying the solvent vapors enters the condenser 18 through inlet conduit 72 and first flows over primary condensing coils 74 and 76, which are cooled by conventional refrigeration 78 to the condensation point of water. The water collects on the primary coils 74 and 76. A water pan 80 is mounted below said coils 74 and 76 to catch the water dripping from said coils 74 and 76 and the water in the pan 80 is discharged out of a water outlet conduit 82 (FIG. 6). The water pan 80 and the condenser coils 74 and 76 are mounted on a housing 81 by conventional means not shown. The housing 81 is shaped to provide an expansion chamber which causes expansion of the heated inert gas entering housing 81 from conduit 72 to enable the heated inert gas to expand which reduces the velocity of said gas stream before it contacts condensing coils 74 and 76.

To condense the solvent vapors, the condenser contains four secondary condenser coils for illustrative purposes 84, 86, 88 and 90 which are mounted in tandem one above the other and cooled by a refrigerator 78 to progressively lower temperatures as described hereinafter. The coils 84 through 90 are mounted by conventional means not shown in a hollow, rectangular inner housing 92 which is open at both ends. Housing 92 is mounted within a larger outer rectangular housing 94 which is closed on the top and is supported on the bottom by an annular plate 96. The entire assembly is supported by a conventional framework which is not shown in the drawings.

In order to permit the condensed solvents to flow easily out of coils 84 through 90, the coils are generally arranged in a vertical array of pipes and have separate controls to maintain separate temperatures. For this purpose, horizontal headers at the top and bottom of each coil are connected directly to the refrigerator 78 through pipes 98, 100. Accordingly, headers for each of the coils 84, 86, 88 and 90 are connected to a referigerator 78 which is adapted by suitable controls (not shown) to cool coil 90 to the lowest temperature, coil 88 to the next lower, coil 86 to the next lower, and coil 84 to the next lower, so that the inert gas stream traveling upward through coils 84 through 90 is progressively cooled below the condensation point of the solvent vapors so that it condenses on the coils and flows down the vertical portion of the coils and falls into a collection pan 102 mounted an annular plate 96 below the open bottom of inner housing 92. A solvent outlet conduit 104 (FIG. 6) is coupled to pan 102 to drain the solvent therefrom.

With respect to the progressively colder temperature of coils 84, 86, 88 and 90, when the solvent is acetone, which has a condensation point of about 56° C, the following temperatures are used: coil 84, −29° C; coil 86, −34° C; coil 88, −40° C; and coil 90, −51° C. For other solvents, the appropriate temperatures for their particular condensation points will be apparent to those skilled in the art.

The staged temperatures in condenser sections 84, 86, 88 and 90 prevent the liquid solvent from re-evaporating as it travels down to the collector pan. The partial pressure of the solvent vapors in the gas decreases as the said gas travels upward, thus keeping it condensed. Thus progressively lower temperatures along the path of the gas are desirable, until the exiting gas is almost completely stripped of solvent.

In cases where several organic solvents are removed from the web in the same operation, the staged temperature in condenser sections 84, 86, 88 and 90 can be arranged to fractionally condense and separate the solvents, each condenser section being cooled to the condensation point of a corresponding solvent, and a separate pan being placed under each condenser section to catch the condensed solvents, which are then piped to separate storage tanks. Of course, in order to accomplish this separation it may be necessary to greatly enlarge the condenser and make other modifications.

The cold, dry inert gas emerging from the top of the inner housing 92 flows down to an outlet 106 (FIG. 7) in outer housing 94 which leads into a heat exchanger 108 mounted on the annular plate 96. The heat exchanger 108 also receives the refrigerant from the refrigerator 78 and transfers the heat into the dry gas which leaves the heat exchanger 108 through an outlet conduit 110 (FIG. 7) which leads to the vacuum pump 16.

Fractional condenser 18 is operated under a vacuum which reduces the chances of an explosion when flammable solvents are involved and enables the condensation of the solvents to be accomplished in a shorter tower and with less energy than would otherwise be possible.

In the preferred embodiment, the entire system is essentially closed, with the only exposure to the outside environment being the very limited exposure which occurs at the entrance and exit openings for the web in the web dryer. Although because of the unique structure of the web dryer, only a minimum of gas or solvent can escape to the outside or only a minimum amount of air can be introduced into the system, the entrance and exit openings may be further provided with conventional types of seals, or, if desired, blanketed with inert gas.

While for purposes of illustration, the use of a relatively compact web dryer has been described it will be understood that a much larger dryer or a series of such dryers may be employed, if desired, in instances where a higher web speed is desired or the extraction of solvent proceeds more slowly. In addition, it will be understood that the novel web dryer described may be used with advantage without the condenser if so desired as, for example, to dry a web bearing only water in which recycling of the water is not desired and a supply of dry gas is available. Furthermore, it will be apparent that the web dryer unit need not be in a horizontal position, but that it will operate equally effectively in any attitude to accommodate any facility in which it may be installed.

In view of the many possible modifications, the invention is not intended to be limited by the showing or description herein, or in any other manner, except insofar as may be specifically required.

I claim:

1. The method of removing solvent from a web of material bearing such solvent which comprises:

a. introducing a web of material bearing solvent through an opening and into an internal chamber of a web dryer, in which chamber dry gas is being introduced to enhance the vaporization of the solvent and carry solvent vapor from the web;

b. passing said web through at least one solvent stripping slot which further promotes the vaporization of solvent from the web, said web being exposed while passing through said slot to a stream of gas flowing downstream relative to the movement of said web;

c. next introducing said web into a vacuum chamber in which reduced pressure enhances the vaporization of the solvent from the web;

d. then removing said web from the vacuum chamber through at least one additional solvent stripping slot and into a second chamber in which dry gas is being introduced, said web being exposed while passing through the additional slot to a stream of dry gas moving upstream relative to the movement of the web; and e. then collecting the upstream and downstream stream of gas in the vacuum chamber and exhausting such gas from the web dryer.

2. The method of claim 1 in which the web is supported, as it passes through the solvent stripping slot by a stream of gas moving downstream and is supported as it passes through the additional solvent stripping slot by a stream of gas moving upstream.

3. The method of claim 1, in which the web passes through a plurality of spaced apart solvent stripping slots in which it is supported by a stream of gas moving downstream.

4. The method of claim 3, in which the plurality of spaced apart solvent stripping slots are separated by chambers of varied pressure.

5. The method of claim 3, in which the web passes through a plurality of spaced apart additional solvent stripping slots in which it is supported by streams of gas moving upstream.

6. The method of claim 5, in which a plurality of spaced apart additional solvent stripping slots are separated by chambers of varied pressure.

7. The method of claim 1 in which the method is performed in a web dryer which is closed to the outside environment except for the openings through which the web enters and leaves the dryer.

8. The method of claim 1 in which the gas is inert.

9. The method of claim 1 in which the gas is heated.

10. The method of claim 1 in which the web is heated.

11. The method of claim 1 in which the gas leaving the web dryer is introduced into a fractional condenser where the solvent vapor is separated from the gas.

12. The method of claim 11 in which the gas from which the solvent vapor has been separated is introduced into a heat exchanger where it is warmed and then transported by a vacuum pump back to the web dryer.

13. The method of removing solvent from a web of material bearing such solvent which comprises:

a. introducing a web of material bearing solvent through an entrance opening into the interior of a web dryer;

b. moving the web past a radiant heat source which directs radiant heat upon the web thus enhancing the removal of said solvent from the web by vaporization;

c. moving said web through a chamber in which dry inert gas is being introduced to enhance the vaporization of the solvent from the web and to carry the solvent vapor from the web;

d. moving the web from said chamber through a solvent stripping slot which effectively accelerates the flow of gas over the surface of the web so as to disturb the boundary layer of solvent vapor which is attached to the surface of the web thus preventing the formation of a solvent vapor pressure concentration of the web surface which interferes with vaporization of the solvent from the web into a vacuum chamber in which a reduced pressure exists which further enhances the vaporization of the solvent from the web;

e. collecting the solvent vapor bearing gas from the vacuum chamber; and f. then recovering the vaporized solvent from the gas.

14. The method of claim 13 in which the vaporized solvent is recovered from the gas by selective condensation.

15. The method of claim 13 in which the gas from which the vaporized solvent has been recovered is recycled through the web dryer and is heated before introduction into the dryer.

16. A web dryer apparatus for drying a web bearing a solvent, said dryer comprising, a. a housing having a web entrance and a web exit;

b. a plurality of chambers located within said housing, said chambers including a first chamber located adjacent the web entrance, said chamber being provided with at least one gas introduction port so that dry gas may be introduced into said chamber to pick up solvent vapors, a second chamber located adjacent the web exit, said chamber being provided with at least one gas introduction port whereby dry gas may be introduced into said chamber to pick up solvent vapors, and an intermediate vacuum chamber located between said first and second chambers, said intermediate chamber being provided with at least one gas exit port adapted to be connected to a vacuum creating source so that upon creation of a vacuum the gas introduced into the first and second chambers will flow downstream from said first chamber and upstream from said second chamber to said intermediate chamber picking up solvent vapors along the way, and c. at least one solvent stripping slot located between the first chamber and the intermediate chamber and at least one additional solvent stripping slot located between said intermediate chamber and said second chamber, said solvent stripping slot providing a passageway whereby the web may move downstream toward the web exit and the gas introduced into the first chamber may also move downstream to the intermediate chamber and said additional solvent stripping slot providing a passageway whereby web may move downstream toward the web exit and the gas introduced into the second chamber may move upstream to the intermediate chamber so that the gas carrying solvent vapors may be exhausted from said dryer via the gas exit port in the intermediate chamber.

17. The dryer apparatus of claim 16 in which there is a plurality of spaced apart solvent stripping slots between the first and the intermediate chambers.

18. The dryer apparatus of claim 17 in which the plurality of spaced apart solvent stripping slots are separated by chambers of varied pressure.

19. The dryer apparatus of claim 16 in which there is a plurality of spaced apart additional solvent stripping slots between the intermediate chamber and the second chamber.

20. The dryer apparatus of claim 19 in which the plurality of spaced apart additional solvent stripping slots are separated by chambers of varied pressure.

21. A web dryer apparatus for drying a web bearing solvent, said dryer comprising:

a. a housing having a web entrance and a web exit;

b. a plurality of chambers located within said housing, said chambers including a first chamber located adjacent the web entrance, said chamber being provided with at least one gas introduction port so that dry gas can be introduced into said chamber to pick up solvent vapors, and a vacuum chamber located downstream of said first chamber, said vacuum chamber being provided with at least one exit port adapted to be connected to a vacuum creating source so that upon creation of a vacuum the gas introduced into the first chamber will flow downstream from said first chamber to the vacuum chamber picking up solvent vapors along the way;

c. at least one solvent stripping slot located between the first chamber and the vacuum chamber, said solvent stripping slot providing a passageway whereby the web may move downstream towards the web exit and the gas introduced into the first chamber may move downstream to the vacuum chamber so that the gas carrying solvent vapors may be exhausted from the dryer via the gas exit port of the vacuum chamber, said solvent stripping slot being sized to permit the passage of the web and to increase the velocity of gas flow from the first chamber to the vacuum chamber over the web surface so as to disturb the boundary layer of solvent vapor on the web surface and prevent the formation of a solvent vapor pressure concentration on the web surface which can interfere with the evaporation of the solvent from the web;

d. a radiant heat source within the web dryer positioned to direct radiant heat upon the web and to thus enhance the vaporization of the solvent from said web; and e. means located downstream of said vacuum chamber adapted to permit the web to exit from the dryer without the loss of any substantial amounts of the solvent vapor bearing gas from the dryer.

22. The dryer apparatus of claim 21 in combination with a solvent condenser for selectively condensing solvent from the gas exhausted from the dryer.

23. The dryer apparatus of claim 22 in which the condenser has an outlet for dry gas which is connected to the dry gas inlet on the web dryer to form a closed loop of gas flow and there is a pump in said closed loop to impel gas through the loop.

24. The dryer apparatus of claim 23 in which the pump also creates the reduced pressure in the vacuum chamber.

25. The dryer apparatus of claim 22 in which a dry gas heater is located between the condenser and the dry gas inlet of the web dryer to heat the dry gas before entry into said dryer.

26. In an apparatus for drying a continuously moving web bearing a solvent, the combination of:

a web dryer comprising a housing with web entry and exit openings, a number of chambers successively arranged between the openings through which a web is transported, narrowed solvent stripping slot means between the chambers, a dry gas inlet for one of said chambers, a gas outlet for another of said chambers, and a radiant heater in one of said chambers disposed to radiate upon a web within the chamber;

a solvent condenser connected to said gas outlet for selectively condensing solvent from the gas flowing out of said web dryer;

return connections between said condenser and said dry gas inlet of said web dryer to form a closed loop of gas flow; and a pump in said closed loop to impel gas through the loop.

27. An apparatus as in claim 26 in which said chambers of said web dryer include gas inlet chambers at the ends of said dryer housing that have dry gas inlets, and a vacuum chamber medial the inlet chambers that has said gas outlet, said vacuum chamber having a reduced pressure developed therein by said pump.

28. An apparatus as in claim 26 having a dry gas heater in said return connections that elevates dry gas temperation before entry into said web dryer.

* * * * *